US010889466B2

(12) United States Patent
Fonteneau

(10) Patent No.: US 10,889,466 B2
(45) Date of Patent: Jan. 12, 2021

(54) ELEVATOR LANDING DOOR LOCK SAFETY SYSTEM

(71) Applicant: Otis Elevator Company, Farmington, CT (US)

(72) Inventor: Nicolas Fonteneau, Chateauneuf sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 464 days.

(21) Appl. No.: 15/961,178

(22) Filed: Apr. 24, 2018

(65) Prior Publication Data

US 2018/0319624 A1 Nov. 8, 2018

(30) Foreign Application Priority Data

May 2, 2017 (EP) ..... 17305492

(51) Int. Cl.

| | |
|---|---|
| ***B66B 5/00*** | (2006.01) |
| ***B66B 13/22*** | (2006.01) |
| ***B66B 1/34*** | (2006.01) |
| ***B66B 13/16*** | (2006.01) |
| ***B66B 13/24*** | (2006.01) |

(52) U.S. Cl.

CPC ..... *B66B 5/0087* (2013.01); *B66B 1/3407* (2013.01); *B66B 13/16* (2013.01); *B66B 13/22* (2013.01); *B66B 13/24* (2013.01)

(58) Field of Classification Search

CPC ..... B66B 5/0087; B66B 1/3407; B66B 13/16; B66B 13/22; B66B 13/24

USPC ..... 187/391

See application file for complete search history.

(56) References Cited

U.S. PATENT DOCUMENTS

| | | | | |
|---|---|---|---|---|
| 5,727,657 | A | 3/1998 | Foelix | |
| 6,193,019 | B1 * | 2/2001 | Sirigu | B66B 13/22 187/391 |
| 7,410,033 | B2 * | 8/2008 | Veronesi | B66B 7/062 187/391 |
| 8,104,586 | B2 * | 1/2012 | Traktovenko | B66B 1/44 187/391 |
| 9,272,878 | B2 | 3/2016 | Kocher et al. | |
| 9,546,078 | B2 | 1/2017 | Paasisalo | |

(Continued)

FOREIGN PATENT DOCUMENTS

| | | |
|---|---|---|
| CN | 201560031 | 8/2010 |
| CN | 105174003 | 12/2015 |

(Continued)

OTHER PUBLICATIONS

"Detailed Installation & Maintenance Guide", The Peelle Company, May 26, 2010; 84 pages.

(Continued)

*Primary Examiner* — David S Warren

(74) *Attorney, Agent, or Firm* — Cantor Colburn LLP

(57) ABSTRACT

Access prevention systems of elevator landing door locks including a landing door lintel for a landing door of an elevator system, a lock mechanism mounted to the lintel and arranged to enable unlocking of the elevator landing door, and an indicator feature on the lintel and aligned with the lock mechanism to indicate a location of a blocked locking mechanism, wherein the indicator feature is at least one of frangible or breakable to permit access to the lock mechanism when the indicator feature is broken.

15 Claims, 6 Drawing Sheets

(56) References Cited

U.S. PATENT DOCUMENTS

| | | | | |
|---|---|---|---|---|
| 2015/0360911 | A1 | 12/2015 | Macareno et al. | |
| 2016/0335595 | A1* | 11/2016 | Levy | G07C 9/00912 |
| 2018/0202189 | A1* | 7/2018 | Fonteneau | E05B 17/147 |
| 2018/0319624 | A1* | 11/2018 | Fonteneau | B66B 13/16 |
| 2019/0135583 | A1* | 5/2019 | Mauguen | B66B 13/16 |
| 2019/0233252 | A1* | 8/2019 | Philippe | B66B 11/001 |
| 2019/0270612 | A1* | 9/2019 | Montigny | B66B 13/14 |
| 2020/0172380 | A1* | 6/2020 | Schach | B66B 13/306 |

FOREIGN PATENT DOCUMENTS

| | | | |
|---|---|---|---|
| EP | 1471028 | B1 | 2/2007 |
| EP | 1845053 | | 10/2007 |
| EP | 2050704 | | 4/2009 |
| EP | 2229335 | | 9/2010 |
| EP | 2516307 | | 10/2012 |
| GB | 1457617 | | 12/1976 |
| JP | H06278975 | A | 10/1994 |
| JP | 2000072361 | A | 3/2000 |
| JP | 2001058782 | A | 3/2001 |
| JP | 2003252556 | A | 9/2003 |
| WO | 2016207683 | | 12/2016 |
| WO | 2017017702 | A1 | 2/2017 |

OTHER PUBLICATIONS

European Search Report, European Application No. 17305492.5, dated Nov. 21, 2017, European Patent Office; European Search Report 8 pages.

* cited by examiner

ELEVATOR LANDING DOOR LOCK SAFETY SYSTEM

CROSS-REFERENCE TO RELATED APPLICATIONS

This application claims the benefit of European Application No. 17305492.5, filed May 2, 2017, which is incorporated herein by reference in its entirety.

BACKGROUND

The subject matter disclosed herein generally relates to elevator systems and, more particularly, to elevator landing door lock safety devices.

Elevator systems include locking mechanisms that are useable by mechanics, technicians, and other authorized persons. The locking mechanisms can be part of lintels of the elevator systems and thus may be easily accessible by anyone. However, it may be required by safety regulations and/or advantageous to prevent access to and/or operation of the elevator locking mechanisms at certain times (e.g., when a technician or mechanic is performing a maintenance operation). Accordingly, safety devices that prevent access to the elevator system locking mechanisms may be desirable.

SUMMARY

According to some embodiments, access prevention systems of elevator landing door locks are provided. The access prevention system include a landing door lintel for a landing door of an elevator system, a lock mechanism mounted to the lintel and arranged to enable unlocking of the elevator landing door, and an indicator feature on the lintel and aligned with the lock mechanism to indicate a location of a blocked locking mechanism, wherein the indicator feature is at least one of frangible or breakable to permit access to the lock mechanism when the indicator feature is broken.

In addition to one or more of the features described above, or as an alternative, further embodiments of the access prevention systems may include that the lintel comprises a lintel frame and a lintel cover, wherein the lintel cover is mounted to the lintel frame, the lintel cover having the indicator feature and being breakable to provide access to the locking mechanism.

In addition to one or more of the features described above, or as an alternative, further embodiments of the access prevention systems may include a safety plate installed to the landing door lintel at the location of the indicator feature, the safety plate including the indicator feature and when the safety plate is broken a safety action is performed.

In addition to one or more of the features described above, or as an alternative, further embodiments of the access prevention systems may include that the safety action is triggering of a safety mode of operation of the elevator system.

In addition to one or more of the features described above, or as an alternative, further embodiments of the access prevention systems may include that the safety plate is installed between the lintel frame and the lintel cover.

In addition to one or more of the features described above, or as an alternative, further embodiments of the access prevention systems may include a safety chain wherein a portion of a wiring of the safety chain is located on the safety plate, wherein when the safety plate is broken the safety chain is one of electrically broken or electrically tripped.

In addition to one or more of the features described above, or as an alternative, further embodiments of the access prevention systems may include that the elevator system is returned to a normal mode of operation when at least one of the lintel cover or the safety plate are replaced.

In addition to one or more of the features described above, or as an alternative, further embodiments of the access prevention systems may include that the safety plate is a printed circuit board.

In addition to one or more of the features described above, or as an alternative, further embodiments of the access prevention systems may include at least one fastener that fixedly attaches the lintel cover to the lintel frame.

In addition to one or more of the features described above, or as an alternative, further embodiments of the access prevention systems may include that the indicator feature is at least one of a hole, a divot, a depression, a marking, or text on the lintel.

In addition to one or more of the features described above, or as an alternative, further embodiments of the access prevention systems may include an access tool for breaking the lintel at the indicator feature.

In addition to one or more of the features described above, or as an alternative, further embodiments of the access prevention systems may include that the access tool is a drill.

In addition to one or more of the features described above, or as an alternative, further embodiments of the access prevention systems may include that, when the access tool breaks the lintel at the indicator feature, a safety chain of an elevator system is electrically broken or electrically tripped.

In addition to one or more of the features described above, or as an alternative, further embodiments of the access prevention systems may include that at least one of the indicator feature, the lintel, or the safety plate includes one or more frangible portions, wherein the one or more frangible portions are positioned to aid in a breaking of the lintel or the safety plate at the location of the indicator feature and provide access to the lock mechanism.

In addition to one or more of the features described above, or as an alternative, further embodiments of the access prevention systems may include that the one or more frangible portions are arranged to break a safety chain wiring when the lintel or safety plate is broken.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
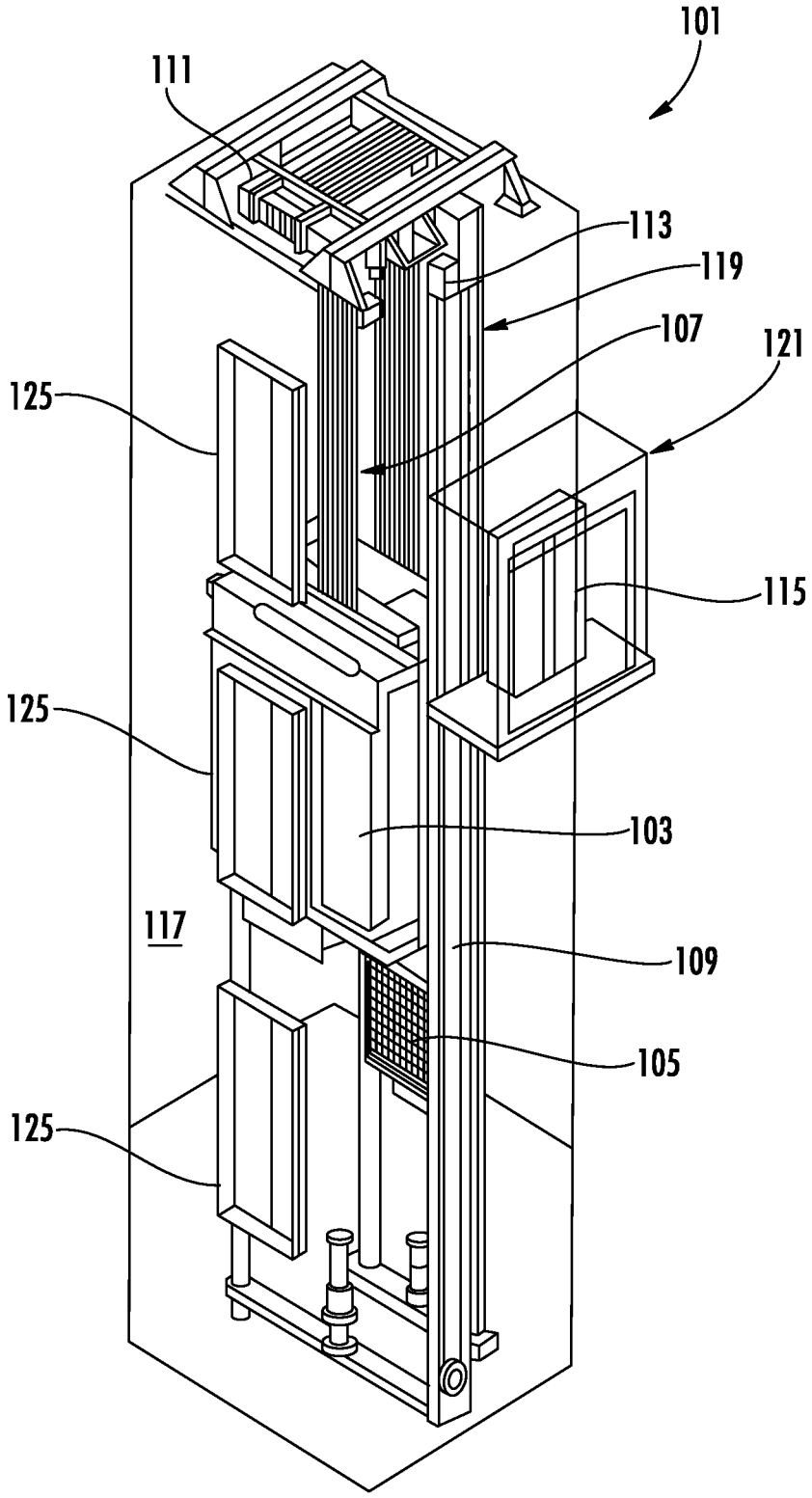
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
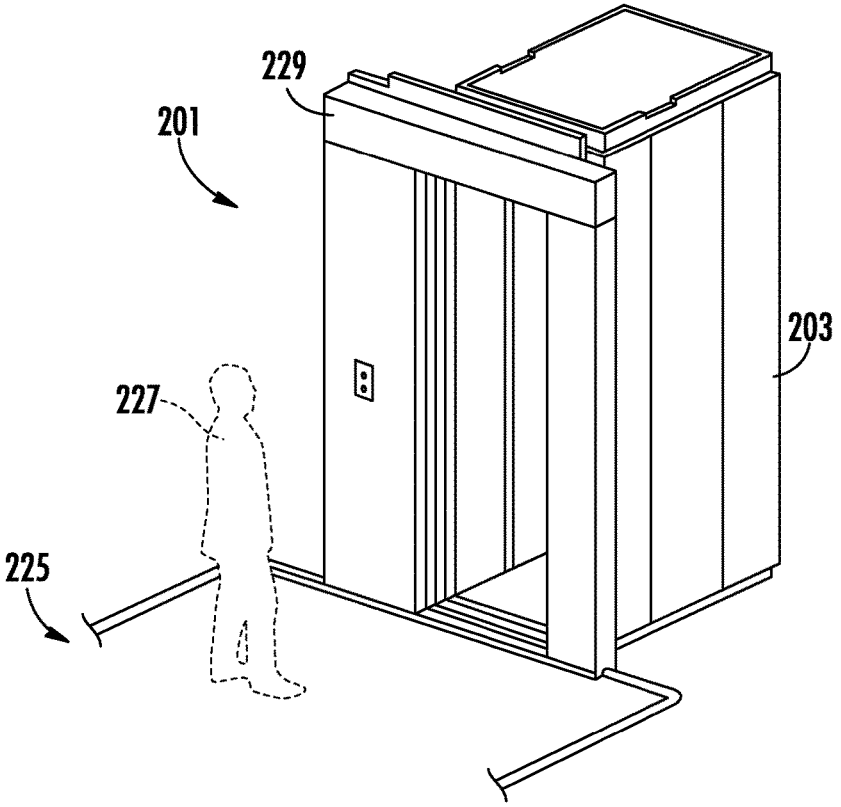
FIG. 2 is a schematic illustration of a landing floor of an elevator system with a hall call panel that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger or mechanic 227 that desires to travel to another floor within a building or perform maintenance on the elevator system 201. In some situations, the mechanic 227 may wish to lock the elevator doors such that they cannot be opened or closed (e.g., to prevent unauthorized persons from accessing the elevator system 201). For example, such situation may arise when the mechanic 227 wishes to enter the elevator pit to perform maintenance therein. Such control or locking can be achieved by a door lock in a lintel 229 of the elevator system 201 (which may be located at each landing 225). It may be advantageous to prevent unauthorized persons from accessing the elevator door lock. Accordingly, embodiments provided herein are directed to an elevator door lock safety device that securely prevents unauthorized access to the elevator door lock.

Figure 3A:
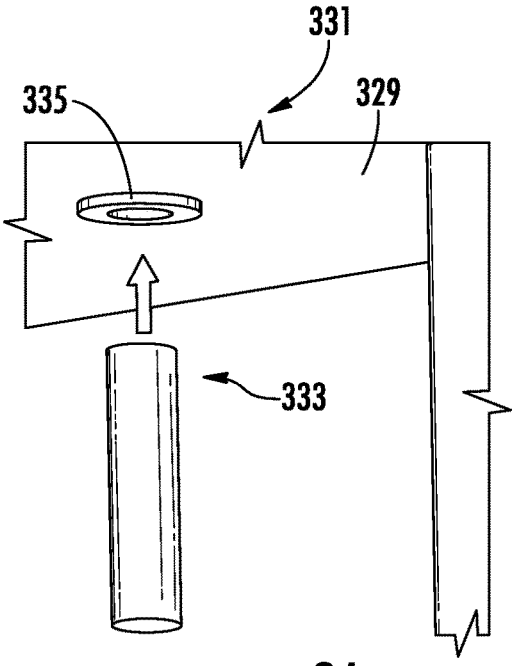
FIG. 3A PRIOR ART
FIG. 3A is a schematic illustration of an elevator door lock safety device in accordance with an embodiment of the present disclosure.
Figure 3B:
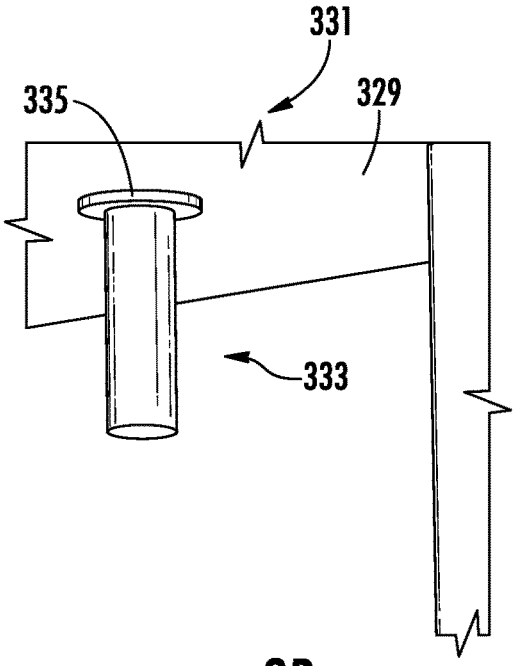
FIG. 3B PRIOR ART
FIG. 3B is a schematic illustration of the elevator door lock safety device of FIG. 3A as inserted into an elevator door lock.

Turning to FIGS. 3A-3B, a traditional elevator lintel door lock 331 is shown. The elevator lintel door lock 331 includes a key 333 that is configured to fit within a keyway 335 of a lintel 329. The keyway 335 and key 333 are selected to operate to enable an authorized person to open an elevator landing door to gain access to an elevator shaft or elevator car located at a respective landing. As shown in FIG. 3B, the key 333 is shown inserted into the keyway 335. A user of the key 333 can unlock the elevator lintel door lock 331 with the key 333 in the keyway 335. As will be apparent, access to the elevator lintel door lock 331 is unobstructed and thus unauthorized persons may gain improper access to the elevator lintel door lock 331, and thus may improperly open elevator landing doors. Further, the keyway 335 may provide an aesthetically unpleasing facade in the lintel 329.

Embodiments provided herein are directed to hiding and/or completely eliminating the keyway. In accordance with some embodiments, the landing door cannot be opened from the landing as there is no longer access to the locking mechanism. That is, emergency access to the landing door locking mechanism is permitted only through specific actions, as described herein. Such actions can enable access to the landing door locking mechanism to permit opening of the landing doors and thus provide access to the elevator shaft. Access may be desired to enable maintenance operations, rescue trapped passengers, and/or for other authorized purposes. Embodiments of the present disclosure include, on the landing door lintel, a very small indicator feature (e.g., 1 mm diameter hole, divot, depression, marking, etc.) to indicate a position where, in an emergency case, a breaking tool can be used to perform a breaking action (e.g., drilling a larger hole) in order to gain access to a locking mechanism installed in direct alignment behind the indicator feature. In the example of a larger hole being drilling in the lintel, a screw driver or a triangular key can be inserted into the larger hold to operate a locking mechanism. Further, in some embodiments, the lintel is designed as a fuse spare part. That is, when performing the breaking action (e.g., drilling, hammering, etc.) an electrical circuit is broken, tripping or breaking an electrical safety chain of the elevator system. As such, to put an elevator system back into normal service, after performing the breaking action, it is required to change or replace the lintel. That is, the breaking action is an action that opens the safety chain or causes the elevator system to enter safe mode until the landing door is fixed back to initial state.

Figure 4A:
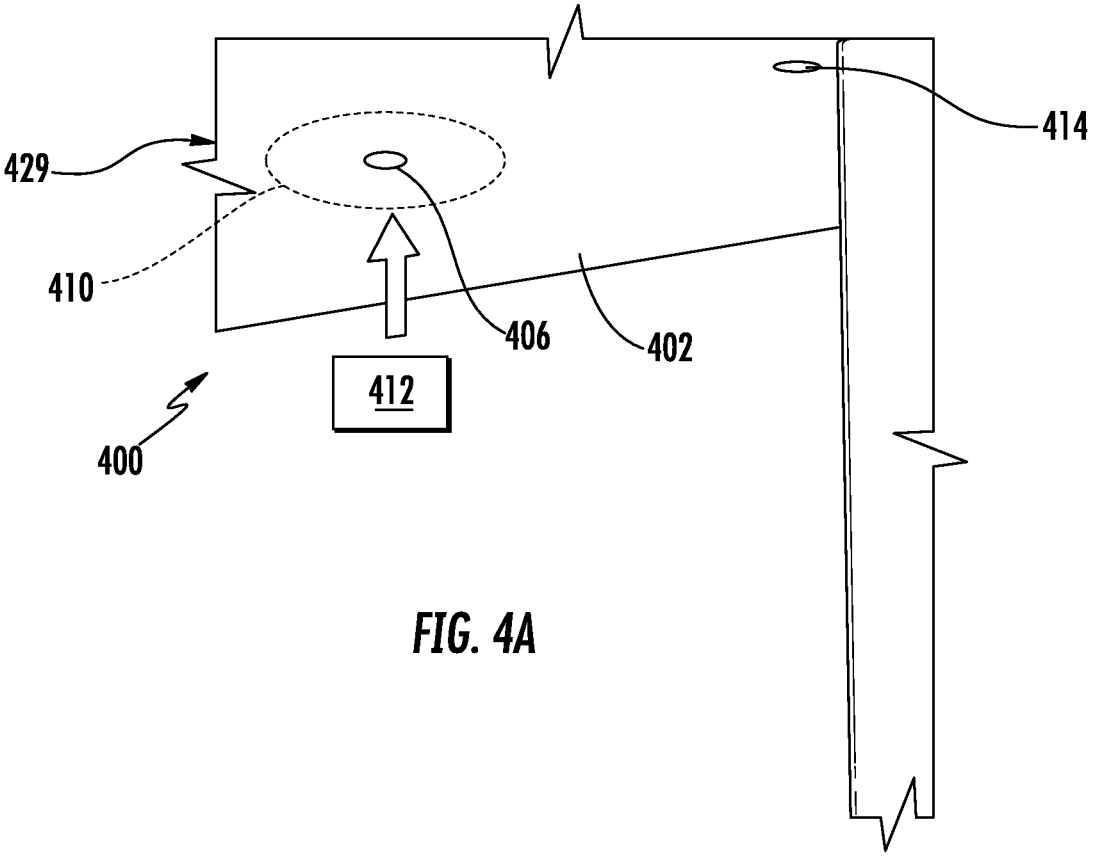
FIG. 4A is a schematic illustration of an access prevention system for elevator landing door locks in accordance with an embodiment of the present disclosure.
Figure 4B:
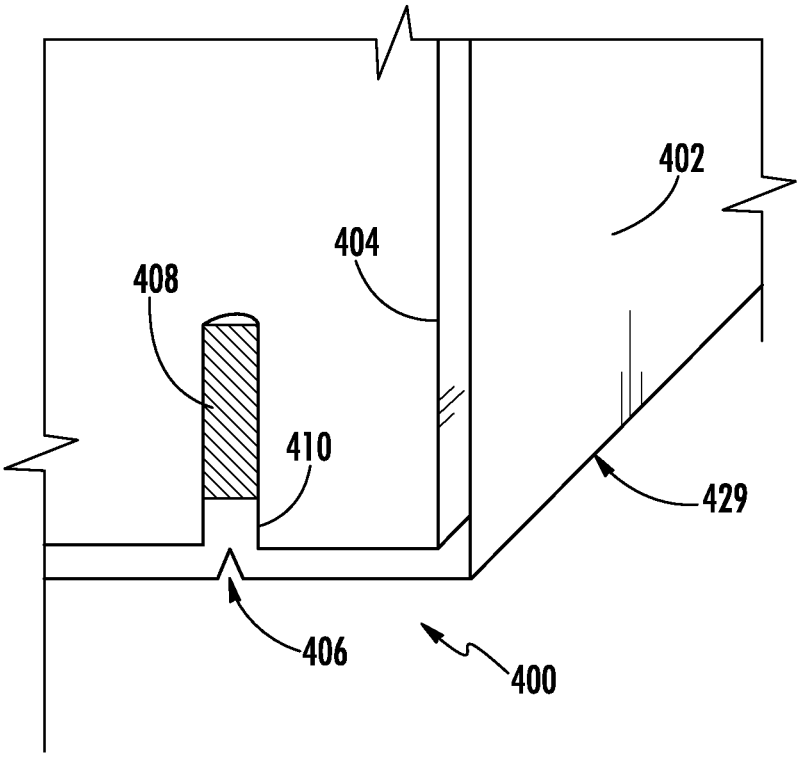
FIG. 4B is a partial cross-sectional schematic illustration of the access prevention system of FIG. 4A.

Turning now to FIGS. 4A-4B, schematic illustrations of an access prevention system 400 in accordance with an embodiment of the present disclosure are shown. FIG. 4A is a perspective isometric illustration of the access prevention system 400 and FIG. 4B is a partial cross-sectional illustration of the access prevention system 400. The access prevention system 400 is provided at a lintel 429 of an elevator landing door, similar to that shown and described above.

The access prevention system 400 the lintel 429 is formed from a lintel cover 402 and a lintel frame 404, although in some embodiments the lintel may be a single or unitary structure. The lintel cover 402 is installed over the lintel frame 404 and can provide an aesthetic facade on the elevator landing. The lintel cover 402 includes an indicator feature 406 that provides an indication of the location of a lock mechanism 408 located within the lintel frame 404. The lock mechanism 408, when operated, enables opening of landing doors, as described above. The lintel frame 404 includes a keyway 410 that provides access to the lock mechanism 408. The lintel cover 402 blocks access to the lock mechanism 408.

The indicator feature 406 is aligned with the keyway 410 such that an authorized person observing the lintel 429 from a landing will know the location of the keyway 410 and the locking mechanism 408. The indicator feature 406 can take various forms. In one non-limiting example, the indicator feature is a small hole or aperture formed in the lintel cover 402. In one such example, the hole may be on the order of 1 mm in diameter. To gain access to the keyway 410 and the locking mechanism 408, an authorized person can use an access tool 412 at the point of the indicator feature 406 to open a larger hole. A key or similar item may then be used to unlock the lock mechanism 408 and a landing door can be opened.

In another embodiment, as schematically shown in FIG. 4B, the indicator feature 406 is an indentation or divot within the surface of the lintel cover 402. Again, the access tool (illustratively shown in FIG. 4A) can be used to puncture or break the surface of the lintel cover 402 to allow for a key or other item to be inserted into the keyway 410. In some embodiments, the indicator feature can be a marking such as a dot, a symbol, text, a circle, etc. that is on the surface of the lintel cover 402. In other embodiments, the indicator feature can be frangible or breakable sections of the lintel cover 402 such that a hammer, screw driver, etc. or other access tool can be used to break the lintel cover 402 at the location of the lock mechanism 408 and/or keyway 410.

The lintel cover 402 is arranged to prevent unauthorized access to the lock mechanism 408. Specifically, when installed the lintel cover 402 prevents viewing of or access to the keyway 410 and/or the lock mechanism 408. However, an authorized person can perform a breaking action to gain access to the keyway 410 and/or the lock mechanism 408.

The lintel cover 402 is a replaceable part or component that can be fixedly attached to the lintel frame 404. In one non-limiting embodiment, the lintel cover 402 is formed of aluminum or sheet metal and can be fixedly attached to the lintel frame 404 by one or more fasteners, adhesives, bonding processes, latches, securing elements, etc. For example, as shown in FIG. 4A, a fastener 414 is illustratively shown that is used to fixedly connect, attach, or mount the lintel cover 402 to the lintel frame 404. After the breaking action is performed using the access tool 412, the lintel cover 402 can be replaced with a new lintel cover 402. The replacement lintel cover can cover the keyway 410 and/or the lock mechanism 408 to prevent access thereto.

Figure 5A:
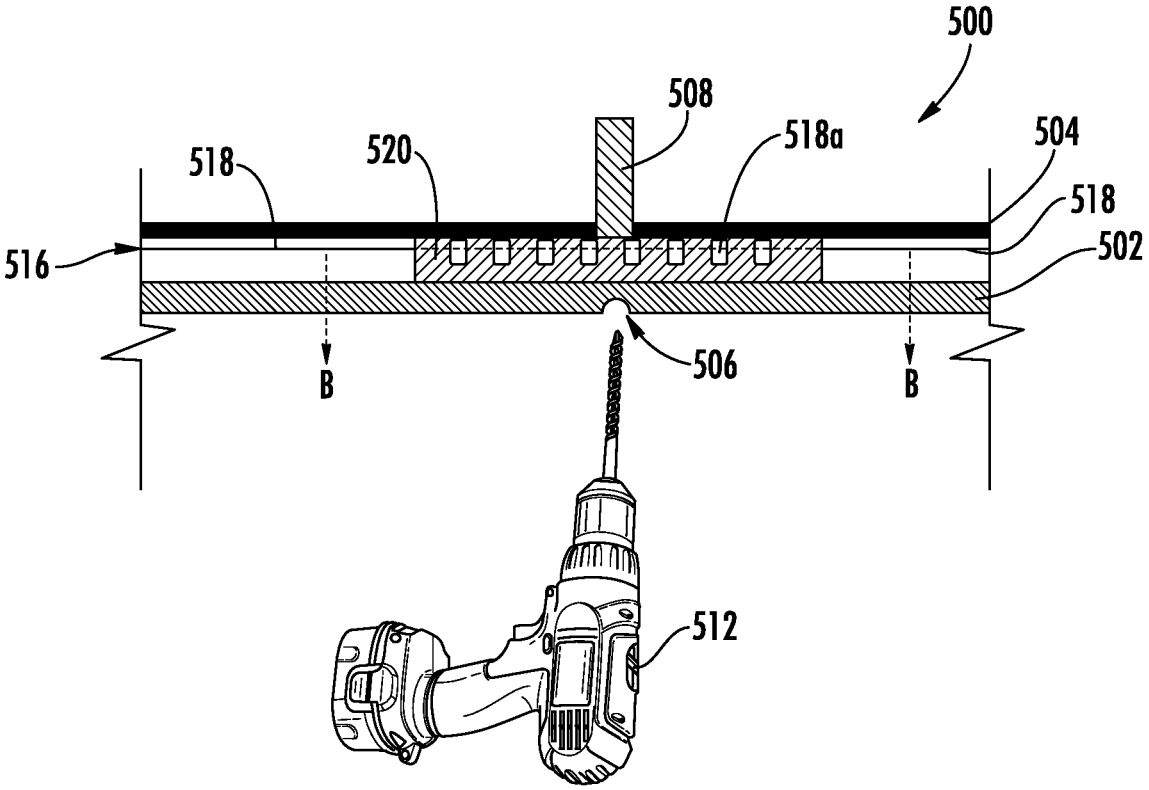
FIG. 5A is a schematic illustration of another access prevention system in accordance with an embodiment of the present disclosure.
Figure 5B:
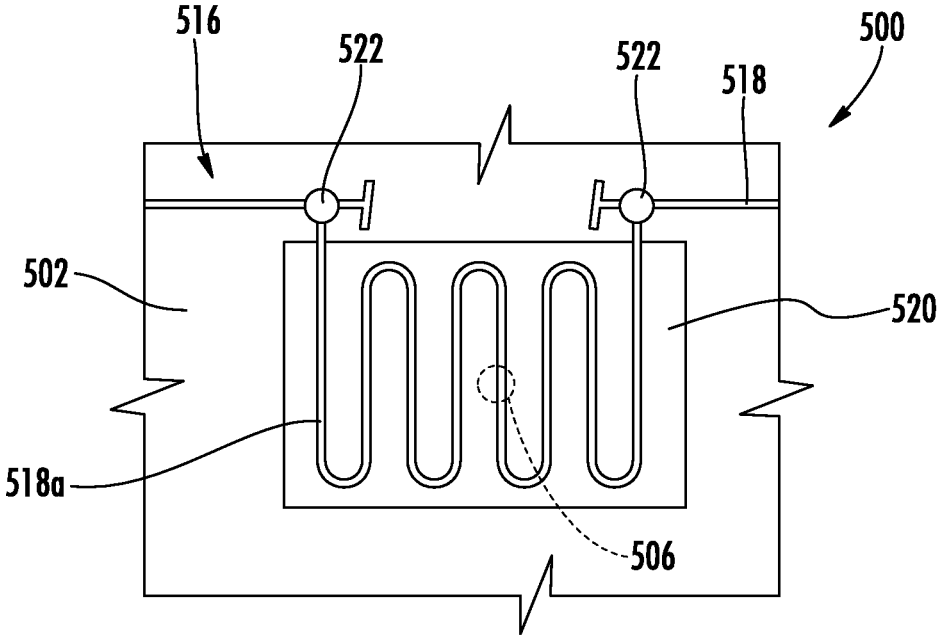
FIG. 5B is a plan view illustration of the access prevention system of FIG. 5A as viewed along the line B-B.

Turning now to FIGS. 5A-5B, an alternative embodiment of an access prevention system 500 in accordance with the present disclosure is shown. FIG. 5A illustrates a side, cross-sectional illustration of the access prevention system 500 and FIG. 5B is a plan view illustration as viewed along the line B-B of FIG. 5A. The access prevention system 500 includes a lintel 529 having a lintel cover 502 and lintel frame 504 as shown and described above. Further, as shown, the lintel cover 502 includes an indicator feature 506, shown as a divot in the surface of the lintel cover 502. An access tool 512, schematically shown as a drill, can be used to break the lintel cover 502 to gain access to a lock mechanism 508 that can be used to unlock a landing door of an elevator system.

In the embodiment of FIGS. 5A-5B, the access prevention system 500 includes an electrical safety chain 516 of the elevator system. The electrical safety chain 516 provides an electrical circuit that is arranged to provide safety features to the elevator system, as will be appreciated by those of skill in the art. For example, the electrical safety chain 516 can be arranged such that if the circuit is broken, the elevator system will enter a safety or maintenance mode of operation that limits various aspects of the elevator car, including, for example, travel speeds of the elevator car within the elevator shaft.

As shown in FIGS. 5A-5B, the electrical safety chain 516 includes wiring 518 and a safety plate 520. In some embodiments, the safety plate 520 may be a printed circuit board. The safety plate 520 includes a portion 518*a* of the wiring 518 and is connected to the rest of the wiring at one or more junctures or connectors 522. The connectors 522 are arranged such that the safety plate 520 and the accompanying wiring thereon can be replaced without having to replace the entire electrical safety chain 516.

As schematically shown, the indicator feature 506 is aligned with a section of the wiring portion 518*a* that is on the safety plate 520. Thus, when the access tool 512 is used to breach or break through the lintel cover 502 to gain access to the lock mechanism 508, the electrical safety chain 516 will be disrupted and thus trigger the safety mode of operation of the elevator system.

In some embodiments, the safety plate 520 having the wiring portion 518*a* thereon can be fixedly attached to the lintel cover 502 such that the safety plate 520 and the lintel cover 502 are a single element or integral piece. In such embodiments, after performing a breaking action, the lintel cover 502 and the safety plate 520 can be replaced with unbroken replacements and the electrical safety chain 516 can be reestablished and the elevator can be operated in a normal mode of operation.

Although described as breaking the wiring portion 518*a* of the electrical safety chain 516, various other mechanisms can be employed without departing from the scope of the present disclosure. For example, when the access tool 512 is used to breach the lintel cover 502 and the safety plate 520, a fuse can be tripped or a short can be affected. Alternatively or in combination therewith, the wiring portion 518*a* can be separate or independent from the wiring 518 of the electrical safety chain 516. In such embodiments, the safety plate 520 can be arranged with various electronic components that can be used to communicate an instruction or signal to an elevator controller to perform a safety action. The safety action can include triggering the safety mode of operation. Such electronic components can include, but are not limited to, processors, memory, communication protocol components, buses, etc. In some embodiments, the breaking of the electrical safety chain 516 can prevent all movement of an elevator car until the electrical safety chain 516 is repaired. Other safety actions that can be performed when the safety plate 520 is broken include, but are not limited to, triggering a message to be delivered to authorized persons or devices (e.g., a monitoring system, fire department, maintenance department, etc.).

Figure 6A:
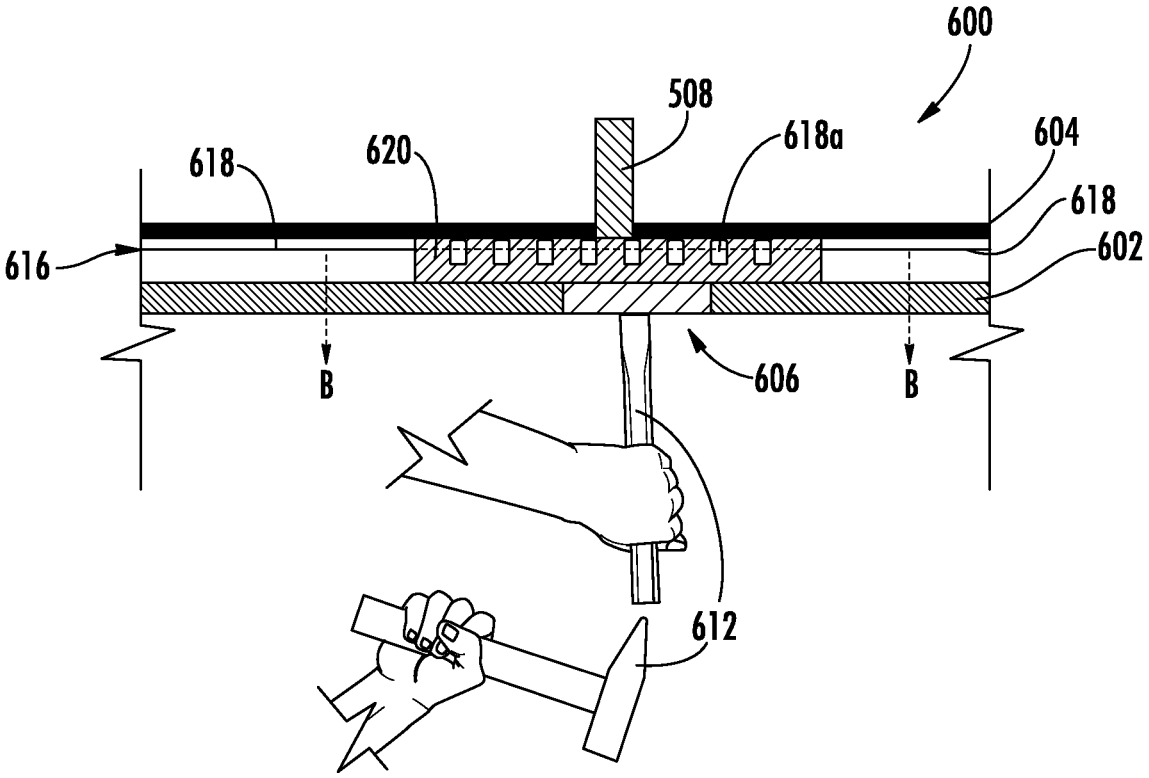
FIG. 6A is a schematic illustration of another access prevention system in accordance with an embodiment of the present disclosure.
Figure 6B:
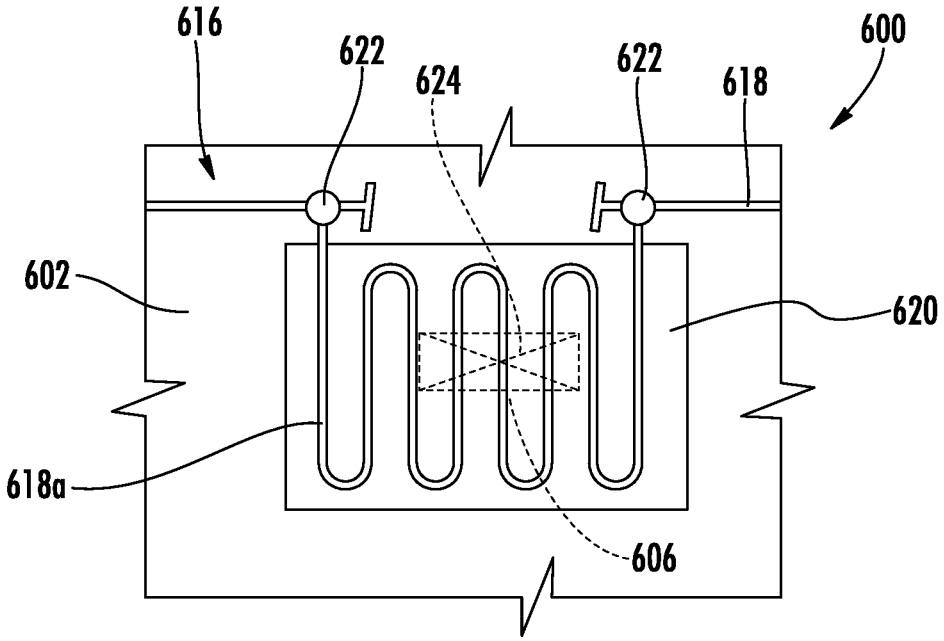
FIG. 6B is a plan view illustration of the access prevention system of FIG. 6A as viewed along the line B-B.

Turning now to FIGS. 6A-6B, an alternative embodiment of an access prevention system 600 in accordance with the present disclosure is shown. FIG. 6A illustrates a side, cross-sectional illustration of the access prevention system 600 and FIG. 6B is a plan view illustration as viewed along the line B-B of FIG. 6A. The access prevention system 600 includes a lintel 629 having a lintel cover 602 and lintel frame 604 as shown and described above. Further, as shown, the lintel cover 602 includes an indicator feature 606, shown as a frangible portion of the surface of the lintel cover 602. An access tool 612, schematically shown as a hammer/chisel, can be used to break the lintel cover 602 to gain access to a lock mechanism 608 that can be used to unlock a landing door of an elevator system.

Similar to the embodiment shown in FIGS. 5A-5B, the access prevention system 600 includes an electrical safety chain 616 of the elevator system. The electrical safety chain 616 includes wiring 618 and a safety plate 620, as described above. The safety plate 620 includes a portion 618*a* of the wiring 618 and is connected to the rest of the wiring at one or more connectors 622. The connectors 622 are arranged such that the safety plate 620 and the accompanying wiring (wiring portion 618*a*) thereon can be replaced without having to replace the entire electrical safety chain 616. As schematically shown, the indicator feature 606 is aligned with a section of the wiring portion 618*a* that is on the safety plate 620. Thus, when the access tool 612 is used to breach or break through the lintel cover 602 at the indicator feature 606 to gain access to the lock mechanism 608, the electrical safety chain 616 will be disrupted and thus trigger the safety mode of operation of the elevator system and/or other action will be performed as described above.

As schematically shown in FIG. 6B, the indicator feature 606 can include one or more frangible portions 624. The frangible portions 624 of the indicator feature 606 can be arranged to have the indicator feature 606 and/or a portion of the lintel cover 602 to break in a predetermined manner to affect a desired result. For example, in some embodiments, and as schematically shown in FIG. 6B, the frangible portions 624 can be arranged to have the indicator portion 606 and a portion of the lintel cover 602 to break into triangular shapes that can pierce and break the safety chain wiring portion 618*a* on the safety plate 620.

Figure 7:
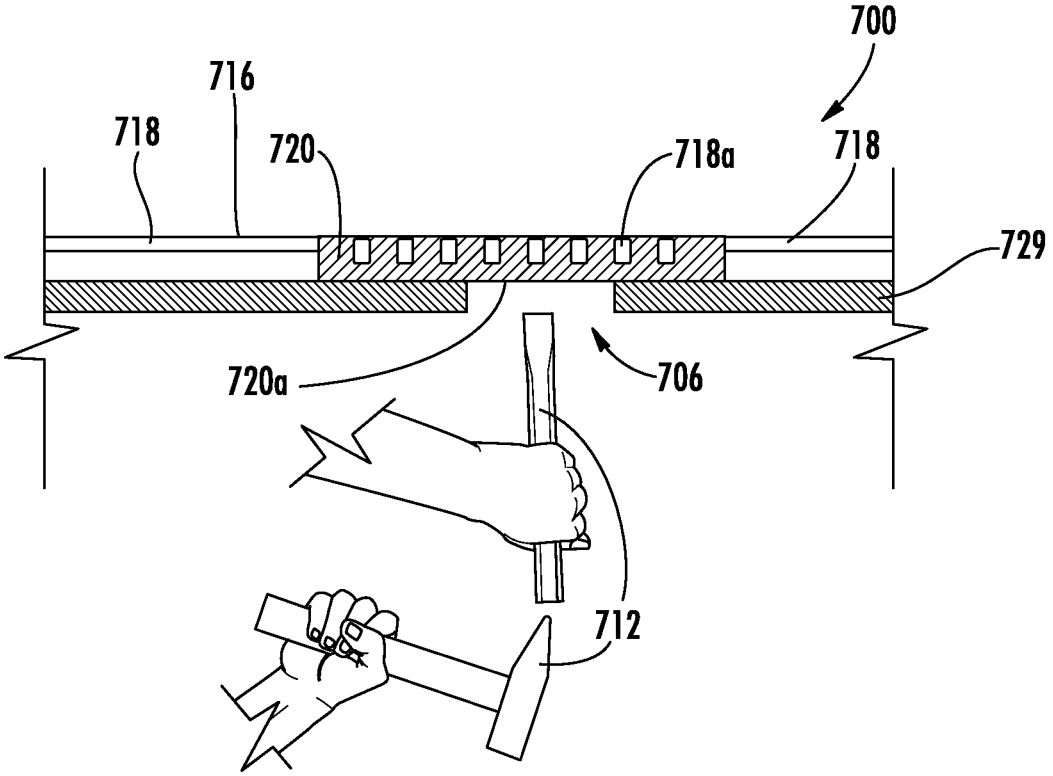
FIG. 7 is a schematic illustration of another access prevention system in accordance with an embodiment of the present disclosure.

Turning now to FIG. 7, an alternative embodiment of an access prevention system 700 in accordance with the present disclosure is shown. FIG. 7 illustrates a side, cross-sectional illustration of the access prevention system 700. The access prevention system 700 includes a safety plate 720 installed to a lintel 729. In the present embodiment, the lintel 729 is a single structure (no separate frame/cover). As shown, an indicator feature 706 is formed within the lintel 729. The indicator feature 706 in such an embodiment may be a hole or other opening, with a facing 720*a* of the safety plate 720 visible from the exterior. In some embodiments, the facing 720*a* of the safety plate 720 can be painted or otherwise arranged to be hidden or at least hard to view to a normal observer. An access tool 712, schematically shown as a hammer/chisel, can be used to break the safety plate 720. Similar to the embodiments described above, the access prevention system 700 includes an electrical safety chain 716 of the elevator system. The electrical safety chain 716 includes wiring 718 and the safety plate 720, as described above. The safety plate 720 includes a portion 718*a* of the wiring 718 and is connected to the rest of the wiring at one or more connectors (as shown above). The connectors are arranged such that the safety plate 720 and the accompanying wiring (wiring portion 718*a*) thereon can be replaced without having to replace the entire electrical safety chain 716.

As schematically shown, the indicator feature 706 is aligned with the safety plate 720. Thus, the access tool 712 is used to breach or break safety plate 720 to thus break the electrical safety chain 716 and disrupt normal operation of the elevator system. Further, in some embodiments, by breaking the safety plate 720, a mechanic or other authorized person can gain access to a lock mechanism (not shown).

In the example embodiment of FIG. 7, a relatively large hole (indicator feature 706) can be present on the lintel 729, with direct access to the safety plate 720. The facing 720*a* of the safety plate 720 can be arranged to provide an acceptable aesthetic and no direct, unauthorized access to the safety chain 716. That is, the facing 720*a* can be a backside of the safety plate 720 (e.g., printed circuit board) that is painted in a color or made from a material that matches or substantially matches the color, pattern, texture, material, or other aesthetic feature of the lintel 729. Once broken with access tool 712, the portion 718*a* of the wiring 718 of the safety chain 716 on the safety plate 720 opens the safety circuit and, in some embodiments, provides access to a locking mechanism. After completion of an authorized action (e.g., safety rescue, maintenance in-shaft, etc.), normal operation can then be re-entered or restarted by replacing the safety plate 720 and completing the circuitry of the safety chain 716. Accordingly, in some embodiments, the lintel cover can be eliminated and yet provide the same safety functionality as the embodiments described above.

In one non-limiting example, when installed, the lintel cover in accordance with the present disclosure will provide an indicator feature that is aligned with a lock mechanism that is part of a lintel frame. The indicator feature indicates where the door locking mechanism is located within the lintel relative to the lintel cover. In this example, the indicator feature is a small hole (e.g., 1 mm in diameter) that can be used to locate and place an access tool, such as a drill. The drill can be used to drill a hole centered on the indicator feature and thus a larger hole is punctured or drilled into the lintel cover. When the puncturing or breaching of the lintel cover occurs, an electrical safety chain can be triggered to halt or minimize operation of an elevator car within the elevator shaft. Further, the larger hole allows for access to a lock mechanism that can be operated using a tool or device such as a key or a screw driver. Accordingly, an authorized person can unlock a landing door and gain access to an elevator shaft (e.g., for an emergency or for performing maintenance). To put the elevator system back into service, the lintel cover must be replaced. That is, if the lintel cover is damaged or missing, the elevator system will not operate or can only operate in a safety mode of operation.

Advantageously, embodiments provided herein enable a secure and safe mechanism for preventing access to an elevator shaft. Further, embodiments provided herein can enable safety modes of operation when access to a lock mechanism is achieved. That is, advantageously, when the landing doors are manually openable by operation of the lock mechanism, the elevator car cannot be operated or can only be operated in a safety mode of operation, thus providing additional safety features. Furthermore, advantageously, lintel covers can be employed that do not readily or easily indicate the location of a lock mechanism and can provide aesthetics to landing door lintels.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although illustrated with a limited number of access tools, those of skill in the art will appreciate that any type of tool or device can be used to break through the lintel cover to gain access to the lock mechanism of embodiments of the present disclosure. Further, although shown and described with a limited number of examples of keys, the unlocking device of embodiments of the present disclosure can take any geometric shape, including, but not limited to, triangular, square, hexagon, octagon, etc.

Accordingly, the present disclosure is not to be seen as limited by the foregoing description, but is only limited by the scope of the appended claims.

What is claimed is:

1. An access prevention system of an elevator landing door lock comprising:

a landing door lintel for a landing door of an elevator system;

a lock mechanism mounted to the lintel and arranged to enable unlocking of the elevator landing door; and an indicator feature on the lintel and aligned with the lock mechanism to indicate a location of a blocked locking mechanism, wherein the indicator feature is at least one of frangible or breakable to permit access to the lock mechanism when the indicator feature is broken.

2. The access prevention system of claim 1, wherein the lintel comprises a lintel frame and a lintel cover, wherein the lintel cover is mounted to the lintel frame, the lintel cover having the indicator feature and being breakable to provide access to the locking mechanism.

3. The access prevention system of claim 1, further comprising a safety plate installed to the landing door lintel at the location of the indicator feature, the safety plate including the indicator feature and when the safety plate is broken a safety action is performed.

4. The access prevention system of claim 3, wherein the safety action is triggering of a safety mode of operation of the elevator system.

5. The access prevention system of claim 3, wherein the safety plate is installed between the lintel frame and the lintel cover.

6. The access prevention system of claim 3, further comprising a safety chain wherein a portion of a wiring of the safety chain is located on the safety plate, wherein when the safety plate is broken the safety chain is one of electrically broken or electrically tripped.

7. The access prevention system of claim 3, wherein the elevator system is returned to a normal mode of operation when at least one of the lintel cover or the safety plate are replaced.

8. The access prevention system of any of claim 3, wherein the safety plate is a printed circuit board.

9. The access prevention system of claim 2, further comprising at least one fastener that fixedly attaches the lintel cover to the lintel frame.

10. The access prevention system of claim 1, wherein the indicator feature is at least one of a hole, a divot, a depression, a marking, or text on the lintel.

11. The access prevention system of claim 1, further comprising an access tool for breaking the lintel at the indicator feature.

12. The access prevention system of claim 11, wherein the access tool is a drill.

13. The access prevention system of claim 11, wherein, when the access tool breaks the lintel at the indicator feature, a safety chain of an elevator system is electrically broken or electrically tripped.

14. The access prevention system of claim 3, wherein at least one of the indicator feature, the lintel, or the safety plate includes one or more frangible portions, wherein the one or more frangible portions are positioned to aid in a breaking of the lintel or the safety plate at the location of the indicator feature and provide access to the lock mechanism.

15. The access prevention system of claim 14, wherein the one or more frangible portions are arranged to break a safety chain wiring when the lintel or safety plate is broken.

* * * * *